United States Patent [19]

Klaus

[11] Patent Number: 4,727,820

[45] Date of Patent: Mar. 1, 1988

[54] FLOATING DOCK

[76] Inventor: Damian Klaus, 21746 Comida Way, Topanga, Calif. 90290

[21] Appl. No.: 907,484

[22] Filed: Sep. 15, 1986

[51] Int. Cl.[4] ..... B63B 35/72

[52] U.S. Cl. ..... 114/263

[58] Field of Search ..... 114/263, 264, 123, 230, 114/248

[56] References Cited

U.S. PATENT DOCUMENTS

| | | | |
|---|---|---|---|
| 2,319,132 | 5/1943 | Hood | 114/123 |
| 2,544,599 | 3/1951 | Keelen | 114/364 |
| 3,646,904 | 3/1972 | Lanning et al. | 114/270 |
| 3,659,546 | 5/1972 | Mikios | 114/248 |
| 3,926,136 | 12/1975 | Shroyer | 114/123 |
| 4,013,032 | 3/1977 | Bludworth | 114/248 |
| 4,328,601 | 5/1982 | Rodler, Jr. et al. | 114/270 |
| 4,520,746 | 6/1985 | Walters et al. | 114/69 |

*Primary Examiner*—Joseph F. Peters, Jr.
*Assistant Examiner*—Jesûs D. Sotelo
*Attorney, Agent, or Firm*—Poms, Smith, Lande & Rose

[57] ABSTRACT

A floating dock for a small vessel has a generally flat buoyant member whose front end is narrower than its rear end. A large indentation extends into the rear end of the buoyant member for receiving the nose of the vessel. When two or more of the buoyant members are attached together with the wider end facing outward, they combine to form a larger floating dock in the shape of a polygon. In one form, the buoyant member is formed of three inflatable rings within an A-shaped or a triangular envelope. There is a space between two of the rings. The envelope has a cut-out portion above the space between the spaced-apart rings to create an indentation to receive the nose of the vessel.

5 Claims, 7 Drawing Figures

FLOATING DOCK

BACKGROUND OF THE INVENTION

1. Field of Invention:

The present invention relates to a transportable floating dock for the type of vessels that are unstable when they are stopped.

2. The State of the Art:

There are a group of highly maneuverable and relatively fast vessels, one of which is sold under the trademark Jet Ski, which can carry one or two persons standing or kneeling on a base. The user holds a handle, which pivots to the nose of the Jet Ski. The handle has the vessel's throttle. One turns a Jet Ski by leaning in the direction of the turn. The center of gravity of a Jet Ski is relatively high, especially when one is standing up. When a Jet Ski is stopped, it is somewhat unstable; the user can balance it, but it takes conscious effort to maintain one's balance. If one wants to stop a Jet Ski and engage in other activities, he or she cannot do so without constantly balancing the vessel. For example, fishing from a Jet Ski is difficult. Even stopping for conversation with other pilots is not convenient. This tends to limit to some degree the usefulness of a Jet Ski.

Jet Skis also have a relatively small space for the pilot. The space is adequate for driving a Jet Ski. The space is uncomfortably small for other social activities. What is needed is a larger space for people when the Jet Ski is stopped without sacrificing the normal compactness of a Jet Ski. Many Jet Ski owners have the other activities on shore after docking and mooring the Jet Ski.

Owners of other vessels do not have this disadvantage. Boats often are anchored away from shore, and the social activities take place there. Most boats are stable. The inside can be made large enough so that other actitivies can take place. Regular boats still can tip over if they are heavily loaded and the location of the center of buoyancy of the boat and occupants changes to cause the boat to become unstable. There are many devices designed to increase the stability of boats. One type exemplified in Shroyer, U.S. Pat. No. 3,926,136 (1975), uses pontoons attached to brackets on the side of a boat to prevent the boat from capsizing. Keelen, U.S. Pat. No. 2,544,599 (1951) and Walters, U.S. Pat. No. 4,520,746 (1985), both teach inflatable floatation collars extending partially or all the way around the hull of a boat. Hood, U.S. Pat. No. 2,319,132 (1943) teaches a buoyant safety cradle that can move up and down into the water around the sides of a boat to prevent the boat from capsizing. Lanning, U.S. Pat. No. 3,646,904 (1972) teaches an assembly of two pontoons held together by braces. The braces are positioned to support a snowmobile. The device is said to allow one to convert a snowmobile into a water vessel. Because of the way the Jet Ski turns by leaning sharply, one cannot have floatation devices permanently extending from the sides of the Jet Ski.

SUMMARY OF THE INVENTION

It is an object of the present invention to disclose and provide a floating dock for the Jet Ski that allows the Jet Ski to be parked at the dock, prevents the Jet Ski from tipping over and provides enough area that one can leave the Jet Ski and sit, stand or lie on the floating dock of the present invention. It is a further object of the present invention to disclose and provide a floating dock for a Jet Ski in which the dock is collapsible and transportable on the Jet Ski.

A further object of the present invention is to disclose and provide a floating dock for a Jet Ski that can be constructed of generally low cost materials. Another object of the present invention is to disclose and provide a floating Jet Ski dock in which two more of the docks can be attached together to make a larger floating platform. The further object related to the previous object is to construct the floating dock in a shape such that when several docks are attached together, the combined docks position the Jet Skis radially outward around a polygon so that each owner has easy access to the Jet Ski of another owner. The combined dock formed of several smaller docks is also more stable.

The prior art explained previously does not meet the objects of the present invention.

The floating dock of the present invention includes a generally flat, buoyant member. It has a front and a rear, and the rear is generally wider than the front. A sufficiently large indentation is provided in the rear to receive the nose of a Jet Ski. Means are also provided for securing the Jet Ski within the indentation. Because the front end of the buoyant member is not as wide as its rear end, if several of the buoyant members are attached together along their sides, the resulting structure will form a curved array. The number of buoyant members required to make a closed structure depends on the difference between the width at the front and rear ends.

The floating dock is designed to inflate and deflate. It is carried in its deflated state on the handle member of the Jet Ski. It can be inflated manually or by using the Jet Ski exhaust.

The buoyant member may be a form of a standard inflatable raft, which would be divided into sections to add strength. In another embodiment, the buoyant member is formed of three circular, inflatable rings in a triangular configuration, but with a space between two of the rings. The three rings are held together by a sheet of plastic, which is secured to the rings or the rings are in a bag-like structure. Part of the sheet or bag is cut away over the space between the two spaced apart rings to create the indentation for the nose of the Jet Ski.

DETAILED DESCRIPTION OF THE PREFERRED EMBODIMENT

Figure 1:
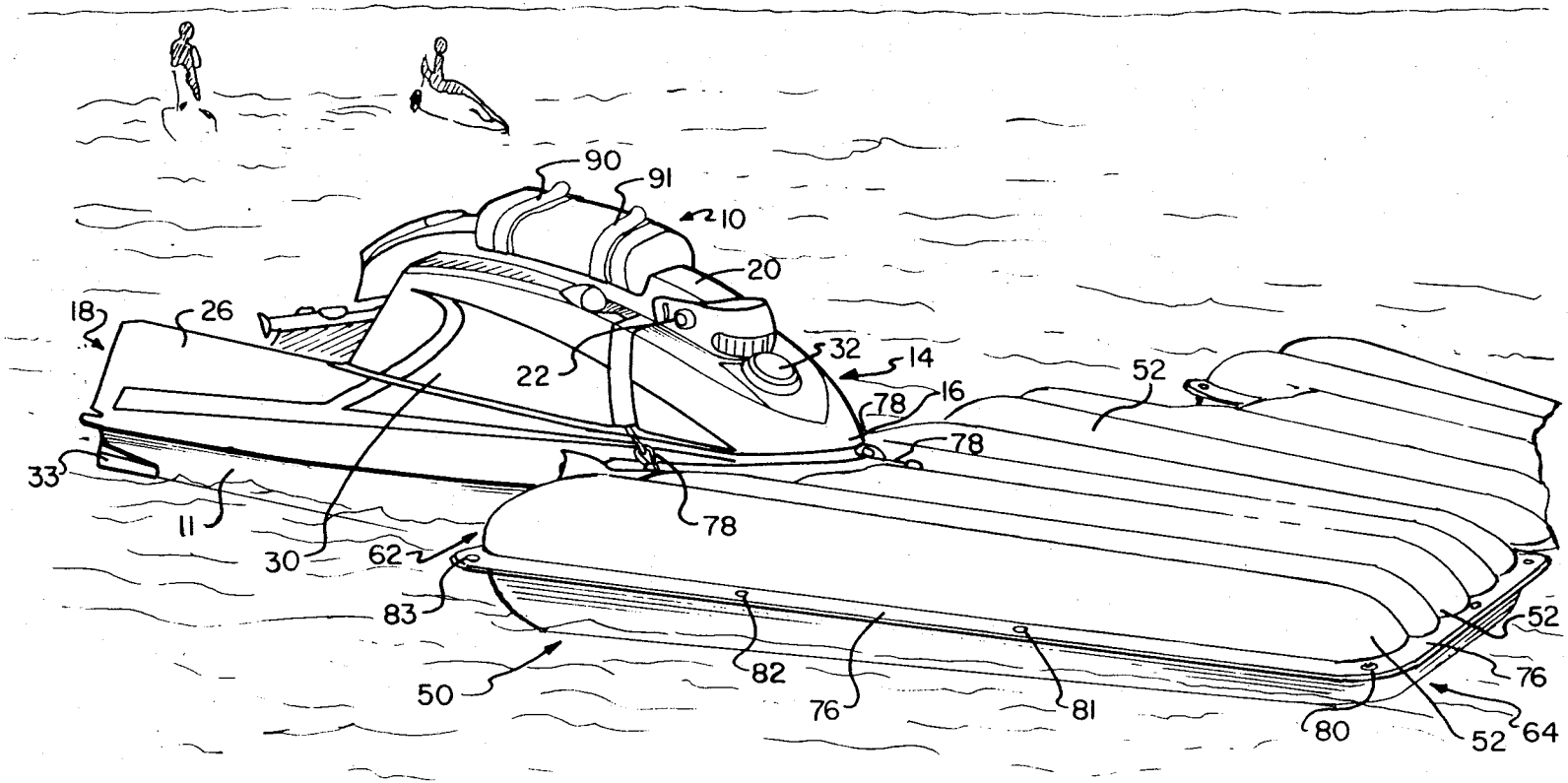
FIG. 1. is a perspective view of a Jet Ski moored to the floating dock of one embodiment of the present invention.

The floating dock of the present invention is designed for use with a certain type of relatively high-powered vessels, which are sold under the trademark Jet Ski. The Jet Ski itself forms no part of the present invention, and familiarity with the operation and structure of a Jet Ski is assumed. A Jet Ski is, however, shown in FIGS. 1, 2 and 3. Jet ski 10 has a hull 12. Fore end 14 has a streamlined nose 16 for movement through water. The aft end 18 rides relatively low in the water. A handle 20 with a throttle control 24 pivots about point 22 at the fore end of the Jet Ski. Floor 28, a space for standing or kneeling, extends from aft end 18 to midships. Gunwales 26 and 27 extend upward from floor 28. Lights 32, 33, and 34 may also be provided on the outside hull for operating the Jet Ski at night.

The operator stands or kneels on floor 28 holding throttle 24 on handle 20. The handle is pivoted upward to a comfortable position. One steers a Jet Ski in a similar fashion that a water ski is steered; by leaning to the port or starboard into a turn. Leaning changes the center of gravity of the operator/Jet Ski combination and causes the Jet Ski to turn. To facilitate turning, however, the Jet Ski has a relatively high center of gravity. Therefore, it tends to be somewhat unstable when it stops.

Figure 2:
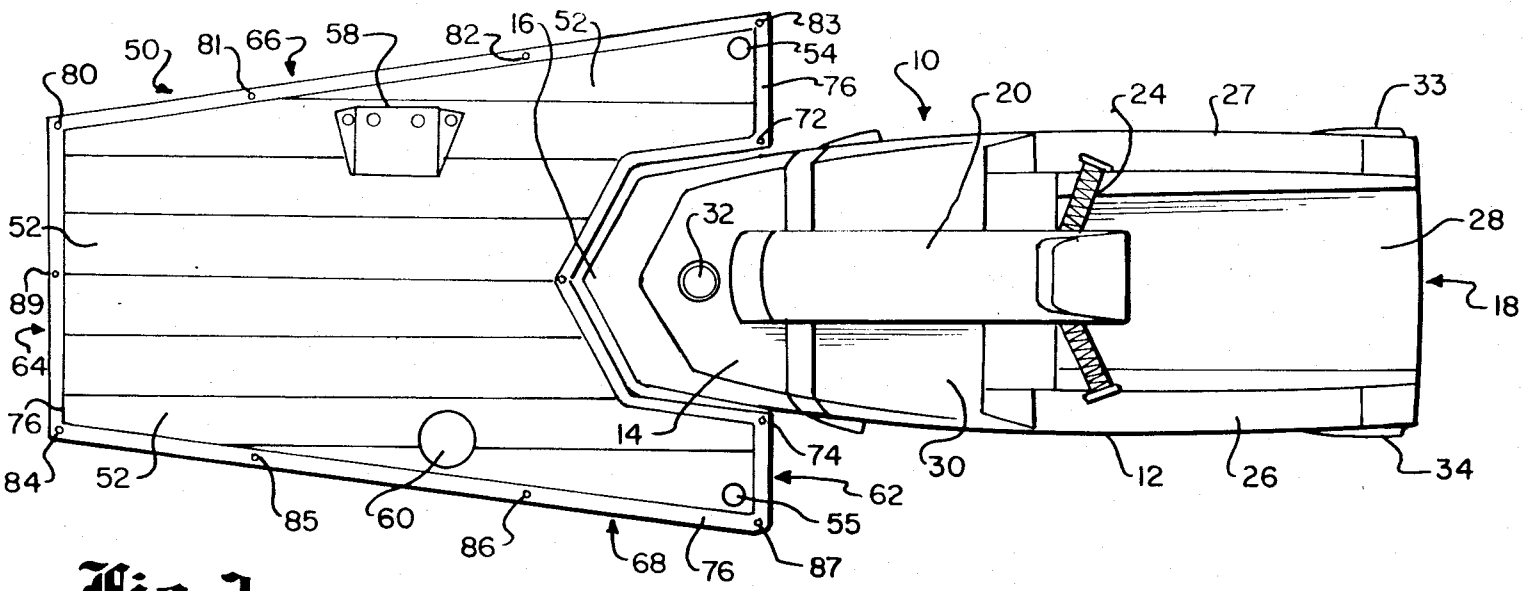
FIG. 2 is a plan view of a Jet Ski moored to one embodiment of the dock of the present invention.
Figure 3:
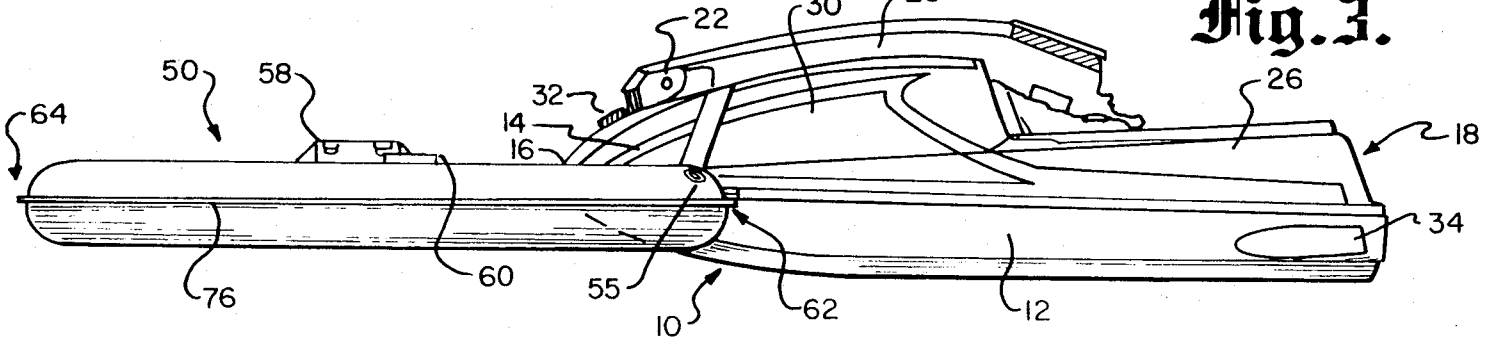
FIG. 3 is a side elevation of a Jet Ski moored to the dock of the present invention.

FIG. 2 shows that floor 28 is relatively small. It is designed to be large enough to allow one to stand or kneel comfortably and even in some instances to carry a passenger. It has no seat, however, and it is not long enough to lie stretched out on. The floor in some Jet Skis is not flat. Some have a longitudinal hump.

The floating dock of the present invention has a generally flat buoyant member with front and rear spaced-apart ends and sides connecting the front and rear ends. In the first exemplary embodiment (FIGS. 1, 2 and 3) buoyant member 50 is an inflatable raft formed of vinyl, rubber or other relatively light weight, but tough material. Buoyant member 50 is divided into several chambers 52. As is known with other rafts, dividing the buoyant member into chambers 52 retains a generally flat shape on the tops of each chamber whether or not one is sitting on the buoyant member. Each chamber 52 may have its own inlet or outlet valve. Such an arrangement prevents all of the air from leaking out of the buoyant member if one of the chambers ruptures. Alternatively, and in the exemplary environment, the chambers are inter-connected, and there are one or two valves for filling or emptying all of buoyant member 50. In the exemplary embodiment, two valves 54 and 55 are provided at separate corners. The valves may be provided with a shape that will fit a hand or foot pump, or they may be attachable to the exhaust of the Jet Ski so that exhaust can be used to inflate the buoyant member. Two valves are provided for filling convenience. Both can be opened when the buoyant members to be deflated to speed that process.

Storage devices may be built on or in the buoyant member. In the exemplary embodiment, flap 58 is provided for holding a small radio. It is designed to be sealed to prevent water from splashing onto the radio. One or more circular openings 60 can be provided for holding a glass or beverage can or bottle.

Figure 4:
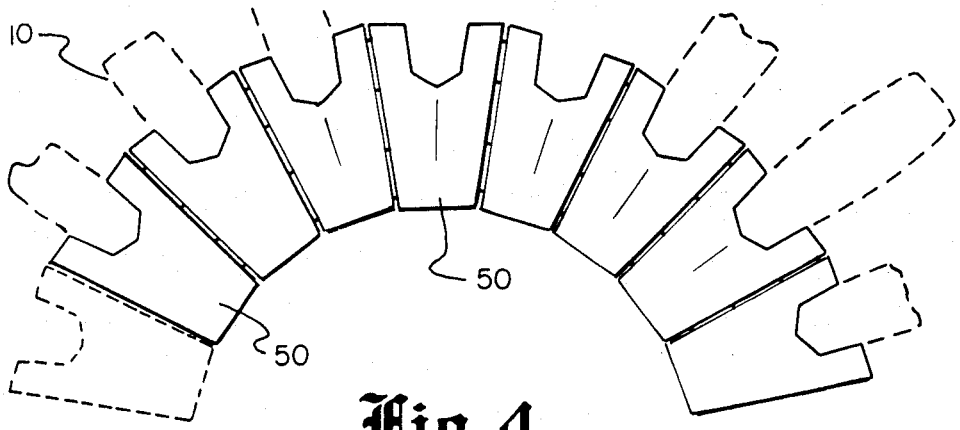
FIG. 4 is a plan view of nine of the floating docks moored together to form a curved array of docks.

Buoyant member 50 has a rear end 62 and a front end 54. The rear end is wider than the front end. As a result, several floating docks can be attached together as shown in FIG. 4 to create an array. The number of floating docks needed to make a closed structure depends on the angle that sidewalls 66 and 68 make with the longitudinal access. The array structure is discussed in more detail below. The rear end 62 of buoyant member 50 has a large indentation to receive one end of the vessel. In the exemplary embodiment of FIGS. 1 through 3, rear end 62 has an indentation 70 shaped to conform to nose 16 of Jet Ski 10 (FIG. 2). Openings 72, 73 and 74 extend through the sealed edge 76 of buoyant member 50. Mooring cables 78 (FIG. 1), which are attached to Jet Ski 10, extend to openings 72–74 to moor the Jet Ski to the buoyant member. Openings 72–74 may be provided with grommets (not shown) to prevent mooring cables 78 from ripping edge 76.

Buoyant member 50 is sufficiently wide, about 4.5 feet (1.4 m) (FIGS. 1–3), to prevent Jet Ski 10 from tipping over on its side. Indentation 70 may be elongated so that more of nose 16 of Jet Ski 10 extends into the indentation, but the dimensions used in the exemplary embodiment are sufficient to prevent tipping. Buoyant member 50 is sufficiently long (approximately 6.3 feet (1.9 m) to provide a large enough surface for comfort.

Several buoyant members 50 are positioned in FIG. 4 to form an array. Attaching clips (not shown) are provided to extend from openings 80, 81, 82, and 83 on the portion of edge 76 on side 66 to corresponding openings 84, 85, 86 and 87 on the portion 76 on side 68. For convenience, each buoyant member would be provided with mooring clips semi-permanently attached to two of the openings on one side of the buoyant member and to two openings in different positions on the other side of the buoyant member. For example, the mooring clips could be attached to openings 80 and 82 on side 66 and to openings 85 and 87 on side 68. Each mooring clip would also have a releasable end, and the releasable end would attach to the empty openings in the adjacent buoyant member.

An additional opening 89 is provided in front wall 64 of buoyant member 10. One can attach two buoyant members together in a front-to-front wall arrangement. Additional openings may also be provided in edge 76 spaced such that the front of one buoyant member could be attached to the side of an adjacent buoyant member. This allows people to modify the array that they might form and provides for maximum flexibility.

When buoyant member 50 is deflated and all of the air is removed, it can be folded into a relatively small package. A pair of bands 90 and 91 (FIG. 1) are attached to handle 20 of Jet Ski 10. When buoyant member 50 is folded into a small package, belts 90 and 91 secure the buoyant member to handle 20. This arrangement provides for ease of transporting the deflated buoyant member 50 to conserve space on floor 28. Several different systems for attaching buoyant member 50 to the handle are also contemplated. For example, a bag-like structure with a sealable end may be provided to enclose the buoyant member. A pocket may also be mounted to the top of handle 20 into which one can slide the deflated buoyant member.

Figure 5:
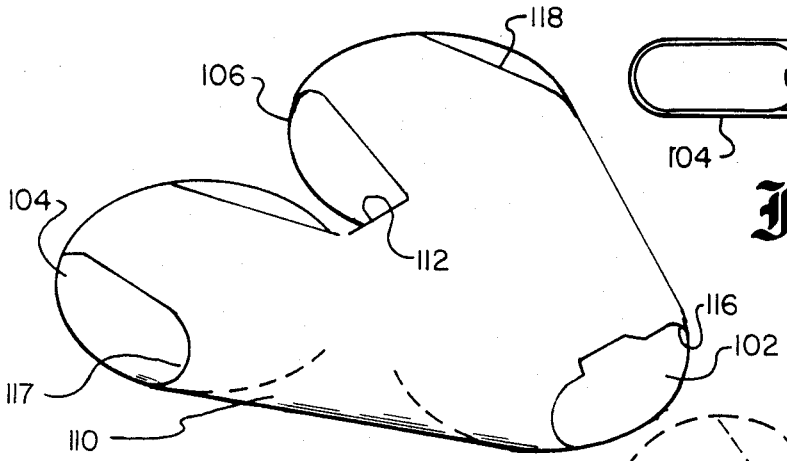
FIG. 5 is a perspective view of a second embodiment of the floating dock of the present invention.
Figure 6:
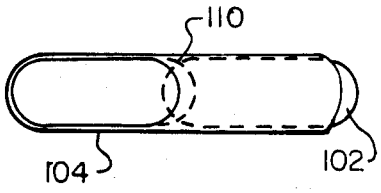
FIG. 6 is a side elevation of the second embodiment of the floating dock of the present invention.
Figure 7:
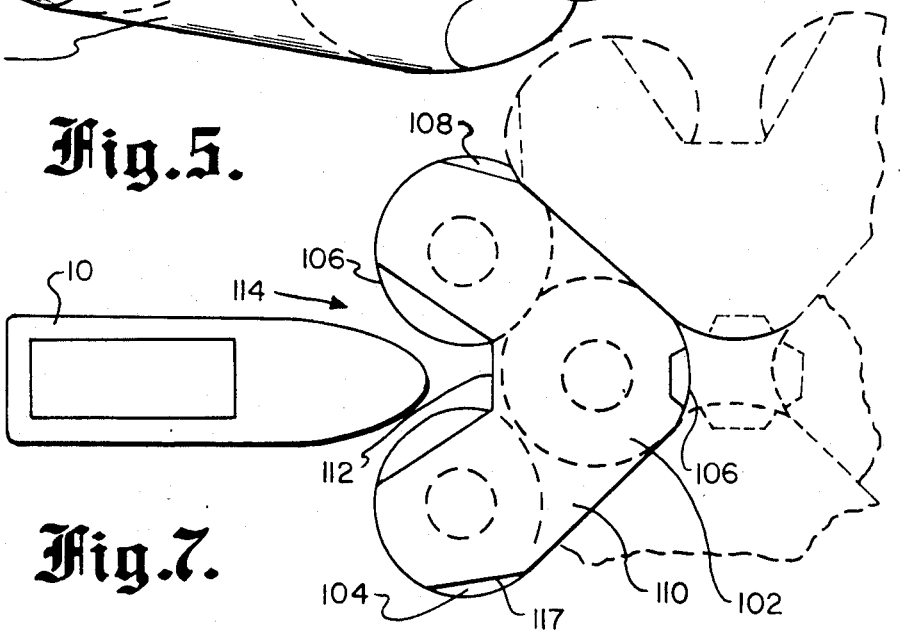
FIG. 7 is a plan view showing the second embodiment of the floating dock of the present invention. Several of the docks are arranged in an array, which is partially shown in FIG. 7.

A second exemplary embodiment shows a modification to the buoyant member. In this embodiment the buoyant member comprises three inflatable rings: a front ring 102 and two back rings 104 and 106 (FIGS. 5, 6 and 7). Rings 102, 104 and 106 are standard floating rings. Each is formed of a tough, flexible material. Each is inflated using a standard valve (not shown). A sheet of flexible material includes securing means which secures the three rings together in the configuration shown in FIGS. 5 and 7. In the exemplary environment, the sheet of material extends over and under as an envelope wherein the sides of the envelope comprise the securing means, in the shape of an A or modified triangle with an indentation 112 at the rear 114. Envelope 110 has spaces 116, 117 and 118 through which a small portion of the corresponding rings extends. The inflation valve for each ring may be positioned to extend out of the space.

Envelope 110 retains the rings such that the rear rings 104 and 106 are somewhat spaced apart from each other at indentation 112, but they are both in contact with the front ring 102 (FIG. 7).

Jet Ski 10 is docked in a similar fashion as in the previous embodiment. The nose of the Jet Ski is urged between adjacent rear rings 104 and 106 in indentation 112. It can then be secured to the rings or to envelope 110 through a connection mechanism (not shown).

The sharper angle of the sides of the floating dock in the second embodiment (FIGS. 5–7) means that only four such members are needed to form a closed structure (FIG. 7). The array of the four docks has means (not shown) for attaching the docks together.

In both embodiments, when the docks are attached together in an array, the rear ends, which have the indentation, project to the outside so that the jet skis are parked radiating outward where they do not interfere with each other. This arrangement is desirable.

I claim:

1. A floating dock comprising:

a. a generally flat, buoyant member having front and rear spaced-apart ends and sides connecting the front and rear ends;

b. a sufficiently large indentation in the rear end of the buoyant member to receive one end of a vessel; and c. wherein the buoyant member comprises three inflatable rings arranged in a triangular configuration with a space between two of the rings, a sheet of material on the rings and securing means associated with the sheet of material for holding the rings in their configuration.

2. The floating dock of claim 1 wherein the sheet of material is generally in the shape of an A, and having a cutout section over the space between the two rings.

3. A floating dock comprising a generally flat, buoyant member having front and rear spaced-apart ends and sides connecting the front and rear ends, a sufficiently large indentation in the rear end of the buoyant member to receive one end of a vessel, wherein the buoyant member comprises three inflatable rings arranged in a triangular configuration with a space between two of the rings, an envelope of material around the rings for holding the rings in their configuration.

4. The floating dock of claim 3 wherein the envelope is generally in the shape of an A, and having a cutout section over the space between the two rings.

5. A floating dock comprising at least two generally flat, buoyant members, each having front and rear spaced-apart ends and sides connecting the front and rear ends; a sufficiently large indentation in the rear end of each buoyant member to receive one end of a vessel, and wherein the buoyant member comprises three inflatable rings arranged in a triangular configuration with a space between two of the rings, a sheet of material on the rings and securing means associated with the sheet of material for holding the rings in their configuration, and wherein the rear end of each buoyant member is wider than the front end of the buoyant member, the floating dock further comprising spaced-apart attaching means on the sides of the buoyant member for attaching adjacent buoyant members together.

* * * * *